US009309717B2

(12) United States Patent
Hardison, III et al.

(10) Patent No.: US 9,309,717 B2
(45) Date of Patent: Apr. 12, 2016

(54) POWERED SAFETY CURTAINS

(75) Inventors: Carl David Hardison, III, Preston, IA (US); David Swift, Dubuque, IA (US); Ryan Pfaff, Dubuque, IA (US); Ryan P. Beggs, Dubuque, IA (US)

(73) Assignee: RITE-HITE HOLDING CORPORATION, Milwaukee, WI (US)

( * ) Notice: Subject to any disclaimer, the term of this patent is extended or adjusted under 35 U.S.C. 154(b) by 318 days.

(21) Appl. No.: 13/402,662

(22) Filed: Feb. 22, 2012

(65) Prior Publication Data

US 2013/0112358 A1 May 9, 2013

Related U.S. Application Data

(63) Continuation-in-part of application No. 13/288,790, filed on Nov. 3, 2011.

(51) Int. Cl.
*A47G 5/02* (2006.01)
*E06B 9/86* (2006.01)
(Continued)

(52) U.S. Cl.
CPC ..... *E06B 9/86* (2013.01); *E06B 2009/689* (2013.01); *E06B 2009/6845* (2013.01); *E06B 2009/804* (2013.01); *E06B 2009/805* (2013.01)

(58) Field of Classification Search
CPC ..... E05B 53/00; E05B 47/0696; E06B 9/54; E06B 9/86; E06B 9/90; E06B 2009/6818; E06B 2009/6836; E06B 2009/6845; E06B 2009/6809
USPC ..... 160/266, 267.1, 268.1, 270, 271, 272, 160/275, 276, 290.1, 31, 1, 2, 7; 49/31
See application file for complete search history.

(56) References Cited

U.S. PATENT DOCUMENTS 3,803,943 A 4/1974 Woloszyk
4,651,940 A 3/1987 Nakamura
(Continued)

FOREIGN PATENT DOCUMENTS

CN 1580479 2/2005
CN 101438024 A 5/2009
(Continued)

OTHER PUBLICATIONS

PCT, "International Search Report and Written Opinion," issued in connection with PCT Application No. PCT/US2012/063266, dated Jan. 25, 2013 (14 pages).
(Continued)

*Primary Examiner* — Syed A Islam
*Assistant Examiner* — Jeremy Ramsey
(74) *Attorney, Agent, or Firm* — Hanley, Flight and Zimmerman, LLC

(57) ABSTRACT

Powered safety curtains are disclosed herein. An example safety barrier assembly to control access to equipment includes a track and a barrier including a receptacle. The barrier is to be moveable within the track between an open position and a closed position. The open position is to enable access to the equipment, the closed position to substantially prevent access to the equipment. The example safety barrier assembly also includes a sensor to identify when the safety barrier is in the closed position and a securing device comprising a portion to be received by the receptacle when the barrier is identified as being in the closed position. An interaction between the portion and the receptacle is to prevent the barrier from moving out of the closed position.

16 Claims, 11 Drawing Sheets

(51) Int. Cl.
*E06B 9/68* (2006.01)
*E06B 9/80* (2006.01)

(56) References Cited

U.S. PATENT DOCUMENTS

| | | | | | |
|---|---|---|---|---|---|
| 5,353,859 | A * | 10/1994 | Oltahfer et al. | ..... | 160/310 |
| 5,450,888 | A * | 9/1995 | Schwartzman et al. | ..... | 160/10 |
| 5,533,561 | A * | 7/1996 | Forehand, IV | ..... | 160/188 |
| 5,839,227 | A | 11/1998 | Gardner | | |
| 6,225,768 | B1 | 5/2001 | Cookson et al. | | |
| 6,234,291 | B1 * | 5/2001 | Koenders | ..... | 192/134 |
| 6,325,195 | B1 | 12/2001 | Doherty | | |
| 6,598,648 | B1 | 7/2003 | Schulte | | |
| 7,355,363 | B2 | 4/2008 | Angiuli et al. | | |
| 7,389,807 | B2 * | 6/2008 | Nagare et al. | ..... | 160/273.1 |
| 2004/0055345 | A1 * | 3/2004 | Moore | ..... | 70/257 |
| 2005/0057890 | A1 | 3/2005 | Sidlinger et al. | | |
| 2006/0118253 | A1 * | 6/2006 | Slusarski et al. | ..... | 160/271 |
| 2006/0144530 | A1 | 7/2006 | Nagare et al. | | |
| 2009/0127375 | A1 | 5/2009 | Heimrich et al. | | |
| 2010/0287841 | A1 * | 11/2010 | Ono et al. | ..... | 49/349 |
| 2011/0108214 | A1 | 5/2011 | Komatsu et al. | | |
| 2011/0259060 | A1 * | 10/2011 | Leska et al. | ..... | 70/174 |
| 2012/0261081 | A1 * | 10/2012 | Curtis et al. | ..... | 160/133 |
| 2013/0112354 | A1 | 5/2013 | Hardison, III et al. | | |

FOREIGN PATENT DOCUMENTS

| | | | | | |
|---|---|---|---|---|---|
| DE | 10001201 | | 7/2001 | | |
| EP | 1509665 | | 3/2005 | | |
| FR | 2661210 | A1 | 10/1991 | | |
| FR | 2841292 | | 12/2003 | | |
| GB | 1596237 | | 8/1981 | | |
| JP | 03140589 | A2 | 6/1991 | | |
| JP | 4-39576 | | 4/1992 | | |
| JP | H06-009586 | U | 2/1994 | | |
| JP | H11131944 | A | 5/1999 | | |
| JP | 2002038855 | | 2/2002 | | |
| JP | 2006307493 | A | 11/2006 | | |
| JP | 2007146590 | | 6/2007 | | |
| JP | 2008132347 | A | 6/2008 | | |
| JP | 2010112111 | | 5/2010 | | |
| WO | 9406995 | | 3/1994 | | |
| WO | 03097977 | | 11/2003 | | |
| WO | WO2011006874 | A * | 1/2011 | ..... | E06B 9/86 |
| WO | 2013067312 | | 5/2013 | | |
| WO | 2013067549 | | 5/2013 | | |

OTHER PUBLICATIONS

PCT, "International Search Report and Written Opinion," issued in connection with PCT Application No. PCT/US2012/063974, dated Jan. 25, 2013 (18 pages).

State Intellectual Property Office of the People's Republic of China, "Text of the First Office action", issued in connection with Chinese Patent application No. 201280059042.1, issue on Dec. 31, 2014, 11 pages.

Japanese Patent Office, "Notice of Reasons for Rejection", issued in connection with Japanese patent application No. P2014-540123, mailed on Feb. 3, 2015, 11 pages.

United States Patent and Trademark Office, "Non-Final Office action", issued in connection with U.S. Appl. No. 13/288,790, Feb. 6, 2015, 25 pages.

International Bureau, "International Preliminary Report on Patentability", issued in connection with PCT patent application No. PCT/US2012/063974, mailed on May 15, 2014, 8 pages.

International Bureau, "International Preliminary Report on Paentability", issued in connection with PCT patent application No. PCT/US2012/063266, mailed on May 15, 2014, 11 pages.

United States Patent and Trademark Office, "Final Office action", issued in connection with U.S. Appl. No. 13/288,790, mailed on Aug. 28, 2015, 29 pages.

Australian Patent Office, "Patent Examination Report No. 1", issued in connection with Australian patent application No. 2012332070, Aug. 26, 2015, 6 pages.

Australian Patent Office, "Patent Examination Report No. 1", issued in connection with Australian patent application No. 2012332312, Aug. 28, 2015, 6 pages.

Japanese Patent Office, "Notice of Allowance", issued in connection with Japanese patent application No. 2014-540123, issued on Aug. 18, 2015, 5 pages.

Chinese Patent Office, "The Text of the Second Office action", issued in connection with Chinese patent application No. 201280059042.1, mailed on Jun. 17, 2015, 4 pages.

State Intellectual Property Office of the People's Republic of China, "Text of the First Office action", issued in connection with Chinese patent application No. 2012800590436, issued on Feb. 17, 2015, 12 pages.

Japanese Patent Office, "Notice of Reasons for Rejection", issued in connection with Japanese patent application No. P2014-540224, mailed on May 26, 2015, 10 pages.

Chinese Patent Office, "Second office action", issued in connection with Chinese patent application No. 2012800590436, Sep. 21, 2015, 4 pages.

Chinese Patent Office, "Notice of Completing Formalities for Patent Registration", issued in connection with Chinese patent application No. 201280059042.1, Nov. 2, 2015, 8 pages.

Japanese Patent Office, "Notice of Allowance", issued in connection with Japanese patent application No. 2014-540224, issued on Jan. 12, 2016, 4 pages.

Australian Patent Office, "Patent Examination Report No. 2", issued in connection with Australian patent application No. 2012332070, Feb. 8, 2016, 4 pages.

* cited by examiner

POWERED SAFETY CURTAINS

RELATED APPLICATION

This patent arises from a continuation-in-part of U.S. application Ser. No. 13/288,790, filed Nov. 3, 2011, which is hereby incorporated herein by reference in its entirety.

FIELD OF THE DISCLOSURE

This patent generally pertains to barriers and, more specifically, to powered curtains.

BACKGROUND

To help avoid injury, safety barriers are often used for controlling access to moving or otherwise dangerous machinery. Examples of such machinery may include machining centers, saws, shears and press brakes. Some safety barriers have a movable access door with various sensors for determining whether the door is open or closed. In some cases, to prevent unsafe access to the machinery, an automatic latch prevents the door from opening accidentally.

DETAILED DESCRIPTION

The examples disclosed herein relate to safety systems that enable machinery to be safely operated by enabling or preventing access to the machinery based on its state (e.g., a safe state, an unsafe state). In some examples, the safety system includes a barrier or curtain, one or more wireless interlock switches and/or one or more securing devices or solenoids. In operation, when the barrier reaches the closed position, the wireless interlock switch may be activated which in turn conveys a signal to a safety relay, a processor, a control system and/or a safety PLC input. Based on receiving information that the barrier is in a closed and/or down position, the control system may cause and/or send a signal to the securing device to extend an associated locking pin that engages the barrier. In some examples, power is applied to the securing device to retract the locking pin and removed from the securing device to extend the locking pin.

When the locking pin is extended and securing the barrier in the closed position, contacts of the securing device and/or locking switch may be activated which in turn conveys one or more signals to a second second safety relay and/or the safety PLC input. When the control system receives information that both safety relays or safety PLC inputs are active, the control system may determine that the barrier is secured in the closed position. In examples in which safety relays are used, safety rated outputs may be wired in series. In some examples, the control system may be communicatively coupled to the safety system (e.g., one or more elements of the safety system). In some examples, the control system may remote or integral to the safety system.

Example barriers disclosed herein for machine guarding and other applications include a vertically moving rollup curtain with multipurpose guide plates attached to lower corners of the curtain. In some examples, the guide plates add appreciable weight to the curtain. Although additional mass increases a body's inertia, the guide plate's additional weight actually increases the closing speed of some curtains. In some examples, the guide plates also enable or enhance the operation of three safety devices. In some examples, parts of one or more of the safety devices are carried by the guide plates. In some examples, the significant mass of the guide plates provide the lower leading edge of a closing curtain with additional downward momentum. Increasing the curtain's downward momentum provides additional force that, in some examples, helps in forcibly engaging a latch that holds the curtain in its closed position. In some examples, the guide plates provide a soft leading edge curtain with a hard stop edge.

Figure 1:
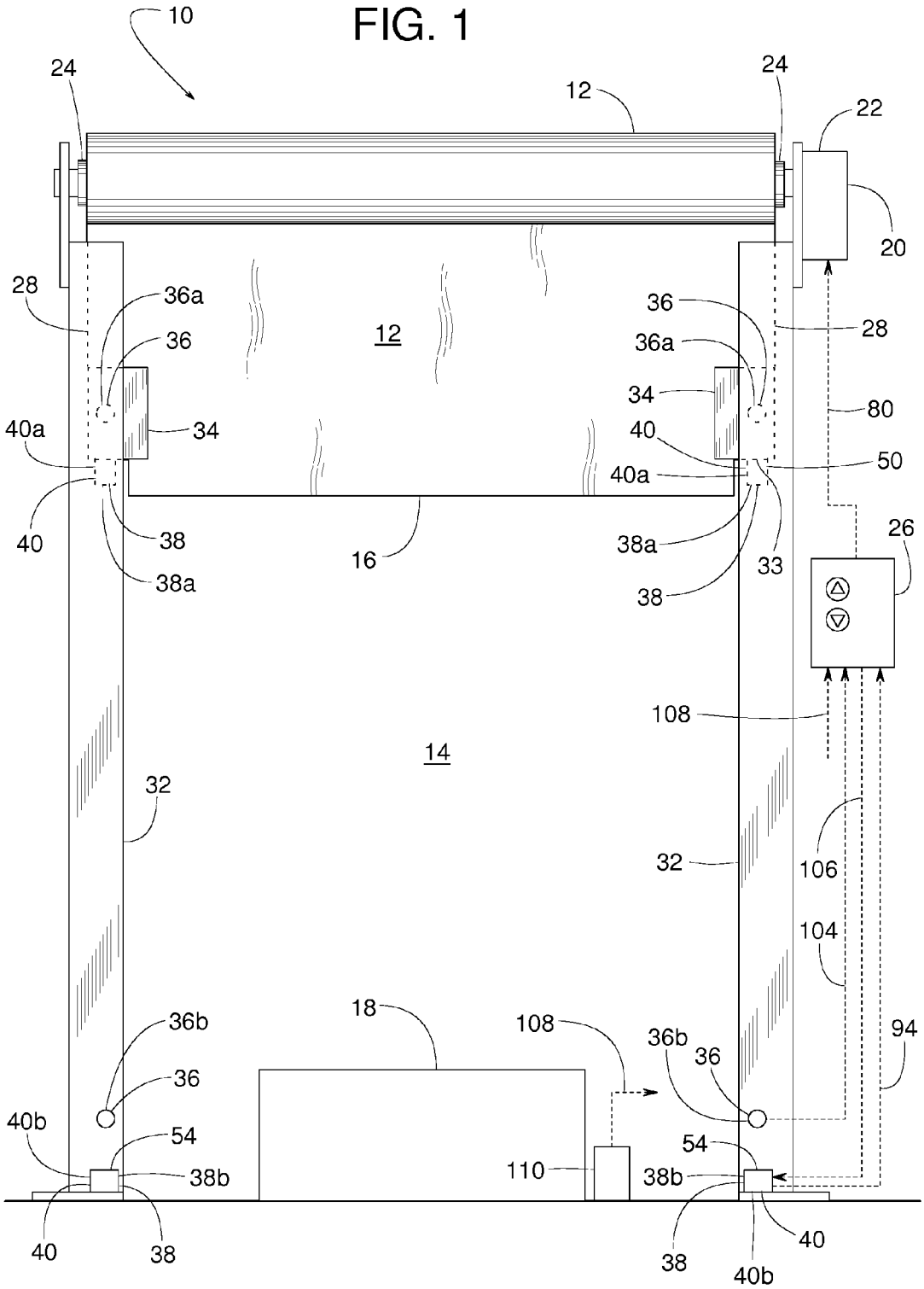
FIG. 1 is a front view of an example barrier with its curtain in an open position.
Figure 2:
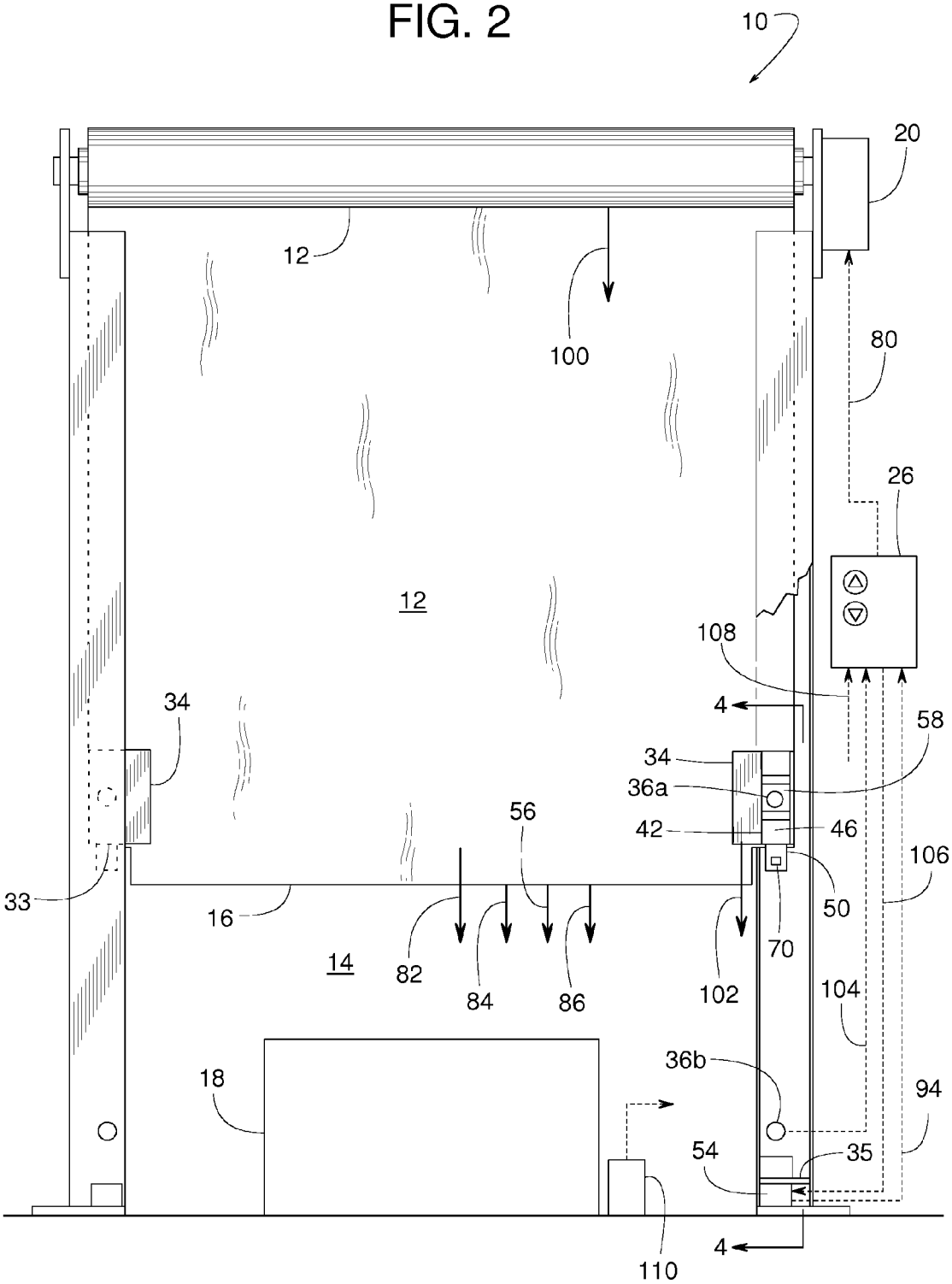
FIG. 2 is a front view of the barrier of FIG. 1 but showing the curtain at an intermediate position between its open and closed positions and showing a portion of the track cutaway.
Figure 3:
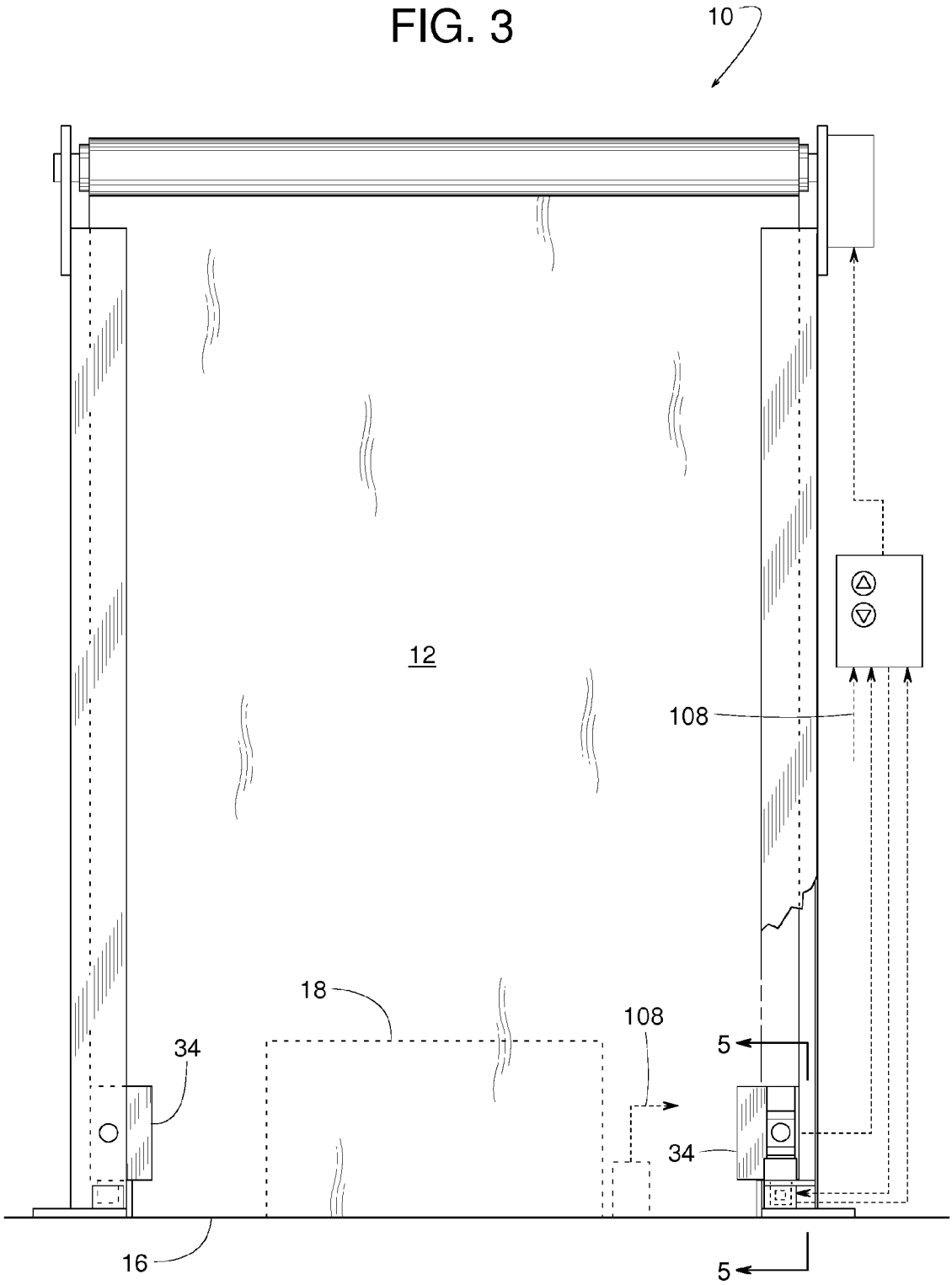
FIG. 3 is a front view of the barrier of FIG. 1 but showing the curtain at its closed position and a portion of the track cutaway.
Figure 4:
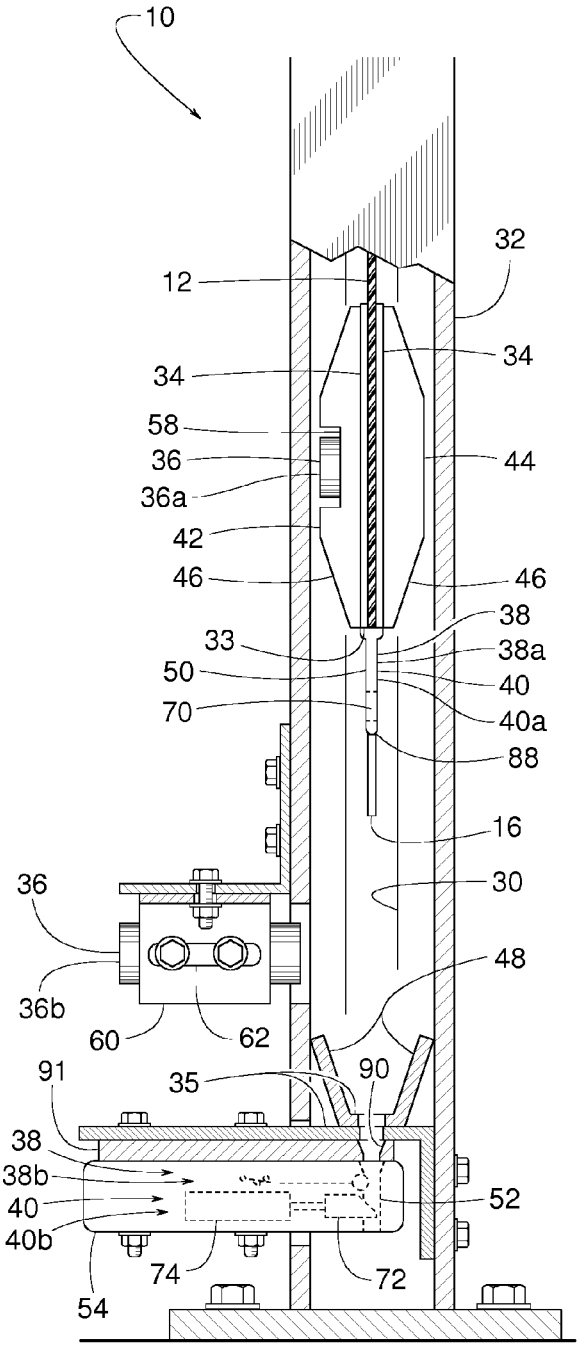
FIG. 4 is a cross-sectional view taken generally along line 4-4 of FIG. 2.
Figure 5:
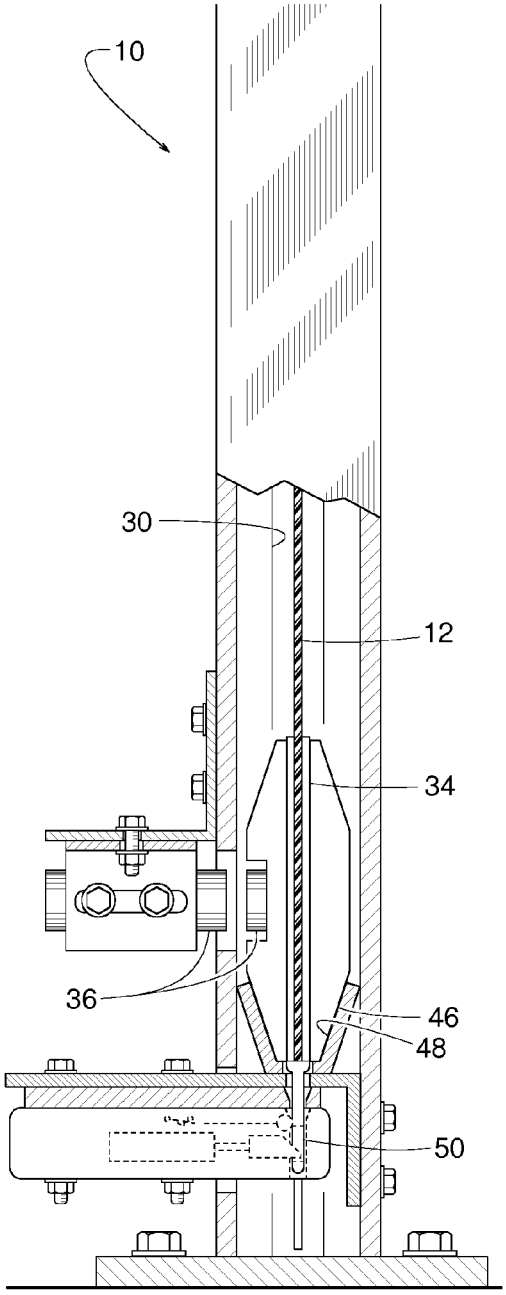
FIG. 5 is a cross-sectional view taken generally along line 5-5 of FIG. 3.

FIGS. 1-5 show an example barrier 10 with an example curtain 12 movable across a chosen opening 14. FIG. 1 shows a leading edge 16 of curtain 12 in an open position to uncover opening 14, FIGS. 2 and 4 show leading edge 16 between its open and closed positions, and FIGS. 3 and 5 show leading edge 16 in its closed position where curtain 12 obstructs opening 14.

Although barrier 10 can be used in a wide variety of applications, barrier 10 includes some safety features that can make barrier 10 very useful as a protective device for providing selective access to a potentially dangerous machine 18. Barrier 10 is particularly useful for guarding machinery having momentum that can maintain a level of danger for a period of time even after the machinery is turned off. Examples of machinery 18 include, but are not limited to, a machining center, a saw, a shear, a press brake, etc.

To open or close barrier 10 by respectively raising or lowering curtain 12, the illustrated example barrier 10 includes a motorized drive unit 20 comprising a motor 22 that rotates a drum 24 about which curtain 12 is wrapped. Depending on the direction of rotation, determined by a controller 26, drum 24 selectively draws curtain 12 up to uncover opening 14 or pays curtain 12 out to lower the curtain across opening 14. When lowering curtain 12, drum 24 controllably releases curtain 12 while the curtain's 12 weight helps pull curtain 12 downward. To help guide the curtain's 12 vertical movement, in this example, curtain 12 includes lateral edges 28 each extending into a slot 30 (FIGS. 4 and 5) in a generally vertical track 32. When barrier 10 is closed, track 32 engaging the curtain's 12 lateral edges 28 helps support curtain 12 along the curtain's 12 vertical length.

The term "curtain" means a sheet of material that when positioned along a generally vertical plane, the sheet of material offers substantially inconsequential vertical support in that the sheet of material when unsupported along its vertical length tends to buckle or collapse under its own weight. Examples of a curtain include, but are not limited to, one or more layers of fabric, one or more layers of pliable polymeric sheeting, a flexible screen, etc. The term "motorized drive unit," as it pertains to a curtain, means any powered apparatus able to raise or lower a curtain. Examples of a motorized drive unit include, but are not limited to, a motor driven drum (e.g., a drum rotated by an electric motor, a hydraulic motor or a pneumatic motor), a winch, a hoist, and a linear actuator (e.g., linear motor, motor driven lead screw, hydraulic cylinder, pneumatic cylinder, etc.). The term "controller" means any electrical system to provide control signals. Examples of a controller include, but are not limited to, a computer, a programmable logic controller (PLC), electrical circuit, electromechanical relays, and various combinations thereof In the illustrated example, barrier 10 includes two multipurpose guide plates 34 at the lower corners of curtain 12. In some examples, each guide plate 34 comprises two plates 34 sandwiching curtain 12 therebetween. Guide plates 34, in some examples, provide numerous functions in enabling or enhancing the lowering of curtain 12 and/or enabling or enhancing the operation of three safety devices and/or sensors 36, 38 and 40 (FIGS. 1 and 4). In some examples, first safety device 36 is a touchless proximity sensor that detects when barrier 10 is closed, second safety device 38 is an electomechanical switch with electrical contacts that are physically forced closed (or forced open) in response to barrier 10 being closed, and third safety device 40 is a solenoid-releasable mechanical latch. In some examples, barrier 10 has six safety devices with one set of safety devices 36, 38 and 40 installed near leading edge 16 and one lateral edge 28 of curtain 12, and another set of safety devices 36, 38 and 40 installed near leading edge 16 at the other lateral edge 28 of curtain 12. While details and examples of safety devices 36, 38 and 40 will be described later, the multiple functions of some examples of guide plates 34 will first be described as follows:

First, guide plates 34, in some examples, adds appreciable weight to the lower end of curtain 12 to help keep curtain 12 vertically taut and to help pull curtain 12 down as drive unit 20 controllably releases curtain 12. To ensure that guide plates 34 exert downward pull on curtain 12, guide plates 34 are made of a material that is denser than the material of curtain 12. Thus, the guide plates 34 are of a weight that urges the curtain 12 to be moved downward during the closing process. In some examples, guide plates 34 are made of steel while curtain 12 comprises polymeric sheeting.

Second, in some examples, one or more guide members 42 and/or 44 (FIGS. 2 and 4) are attached to guide plates 34 to limit the curtain's slack in a horizontal direction and/or to enable the curtain 12 to be substantially taut in the horizontal direction. Guide plates 34 place guide members 42 and 44 inside track 32, and since guide members 42 and 44 cannot fit through the track's relatively narrow slot 30, the lower ends of the curtain's lateral edges 28 are prevented from pulling out from within track 32.

Third, in some examples, guide members 42 and 44 being attached to guide plate 34 provide an excellent firm place to mount a first wireless portion **36*a* of first safety device 36. When barrier 10 is closed, to ensure accurate alignment between first wireless portion 36*a* and a first electrical portion 36*b* of first safety device 36, in some examples, guide member 42 (and/or member 44) has a beveled or tapered surface 46 shaped to matingly engage a tapered lead-in surface 48 (first tapered lead-in surface) that is stationary with track 32. Beveled surface 46 engaging tapered lead-in surface 48 ensures proper alignment with respect to both relative vertical positioning and horizontal spacing between portions 36*a* and 36*b* of safety device 36 (e.g., the portions 36*a*, 36*b* being adjacent one another). Guide plate 34, in some examples, provides curtain 12 with a lower hard stop edge 33. When the curtain's leading edge 16 is relatively flexible, the more rigid hard stop edge 33 provides curtain 12 with a more accurate stopping point as edge 33 engages an end stop 35 on track 32**.

Fourth, in some examples, guide plate 34 provides means for adding to curtain 12 a second wireless portion **38*a* of second safety device 38. Second wireless portion 38*a*, in some examples, is a mechanical actuator in the form of a metal tab or tongue 50 extending from guide plate 34 and being insertable in a slot 52 in a housing 54 that contains a second electrical portion 38*b* of second safety device 38**.

Fifth, in some examples, guide plate 34 provides curtain 12 with sufficient downward momentum 56 (FIG. 7) to force a third wireless portion **40*a* into latching engagement with a third electrical portion 40*b* of third safety device 40. In some examples, second and third wireless portions 38*a* and 40*a* share common structure in the form of a multipurpose actuator. In the illustrated example, wireless portions 38*a* and 40*a* share a common actuator (e.g., tongue 50). Also, in some examples, second and third electrical portions 38*b* and 40*b* are both contained within the same shared housing 54. In the illustrated example, electrical portions 38*b* and 40*b*** share a common housing. The terms, "common actuator" and "common housing" mean two or more parts share the same structure.

Although the structure and use of safety devices 36, 38 and 40 may be implemented and/or performed in numerous different manners, in some examples, first safety device 36 provides a touchless means for sensing whether barrier 10 is closed. As mentioned earlier, first safety device 36 comprises first electrical portion **36*b* and first wireless portion 36*a*. The term, "wireless" as it refers to first, second and third wireless portions 36*a*, 38*a* and 40*a*, means the item (e.g., wireless portion 36*a*) is functional without wires conducting electrical power or electrical signals to or from the item. The term, "wireless" does not necessarily mean that the referenced item (e.g., wireless portion 36*a*) is completely void of an internal electrical circuit. In some cases, for example, first wireless portion 36*a* comprises an RFID device having an internal circuit that is externally stimulated by electromagnet radiation from some examples of first electrical portion 36*b***.

Examples of first wireless portion **36*a* include, but are not limited to, a magnet, a ferrous block, a reflector (e.g., a barcode, white mark, reflective paint, mirror), and an RFID device, etc. More specific examples of first wireless portion 36*a* include, but are not limited to, a model Eva p/n 20-046-xx provided by Jokab Safety of Westland, Mich.; and the non-wired or wireless portion of an Allen-Bradley Sensaguard switch provided by Rockwell Automation of Milwaukee, Wis. Examples of first electrical portion 36***b* include, but are not limited to, a model Adam p/n 2051-xx provided by Jokab Safety of Westland, Mich.; and the wired portion of an Allen-Bradley Sensaguard switch provided by Rockwell Automation of Milwaukee, Wis.

For mounting first safety device 36, some examples of guide member 42 are made of a nonferrous material (e.g., plastic, aluminum, brass) and includes a pocket or recess 58 in which first wireless portion 36*a* is installed. Recess 58 helps protect first wireless portion 36*a* from damage by preventing it from rubbing against the inner surface of track 32, and the nonferrous material quality of guide member 42 minimizes possible communication interference between first electrical portion 36*b* and first wireless portion 36*a*. In some examples, a bracket assembly 60 for mounting first electrical portion 36*b* includes various slots 62 that provide means for adjusting the position of first electrical portion 36*b*.

In some examples, second safety device 38 comprises second electrical portion 38*b* and second wireless portion 38*a* for providing actual physical contact means for determining whether barrier 10 is closed. In some examples, second wireless portion 38*a* is a mechanical member with a physical feature (e.g., the thickness, width and/or edge of tongue 50) that, when barrier 10 is closed, physically closes (or in some examples opens) electrical contacts 64 in the second electrical portion 38*b* of second safety device 38. Examples of second electrical portion 38*b* include, but are not limited to, an internal electromechanical switch (e.g., a switch 66) and its wired or electrical contacts (e.g., contacts 64) of an Allen-Bradley model 440G-MT guard locking switch provided by Rockwell Automation of Milwaukee, Wis.; and an internal electromechanical switch and its wired or electrical contacts (e.g., contacts 64) of an Euchner model STA3A-4141A024RC18 safety switch provided by Euchner-USA, Inc. of East Syracuse, N.Y.

Examples of second wireless portion 38*a* include, but are not limited to, the switch-displacing feature of a mechanical actuator (e.g., mechanical actuator p/n 440K-A11112 or 440K-A17116) of an Allen-Bradley model 440G-MT guard locking solenoid switch provided by Rockwell Automation of Milwaukee, Wis.; and the switch-displacing feature of the mechanical actuator of an Euchner model STA3A-4141A024RC18 safety switch provided by Euchner-USA, Inc. of East Syracuse, N.Y. In addition or alternatively, further examples of second wireless portion 38*a* include, but are not limited to, a tongue sandwiched between two guide plates 34 and protruding downward therefrom, a protrusion integrally extending from guide plate 34 (wherein, "integrally extending from guide plate 34" means that the protrusion and the guide plate comprise a unitary piece without a seam joining the protrusion to the guide plate), and a tongue or protrusion fastened or welded to guide plate 34.

In some examples, third safety device 40 comprises third electrical portion 40*b* and third wireless portion 40*a* for ensuring that curtain 12 is physically held locked in its closed position under certain predetermined conditions. In some examples, third wireless portion 40*a* includes a latching feature (e.g., an opening 70 in tongue 50) that, when barrier 10 is closed, enables third wireless portion 40*a* to hook or otherwise latch onto a plunger 72 extending from a normally extended spring loaded solenoid 74. In some examples, tongue 50 includes physical features for both second and third wireless portions 38*a* and 40*a*. Examples of third wireless portion 40*a* includes, but are not limited to, the latching feature of a mechanical actuator portion (e.g., p/n 440K-A11112 or 440K-A17116) of an Allen-Bradley model 440G-MT guard locking solenoid switch provided by Rockwell Automation of Milwaukee, Wis.; and the latching feature of the mechanical actuator portion of an Euchner model STA3A-4141A024RC18 safety switch provided by Euchner-USA, Inc. of East Syracuse, N.Y.

Figure 6:
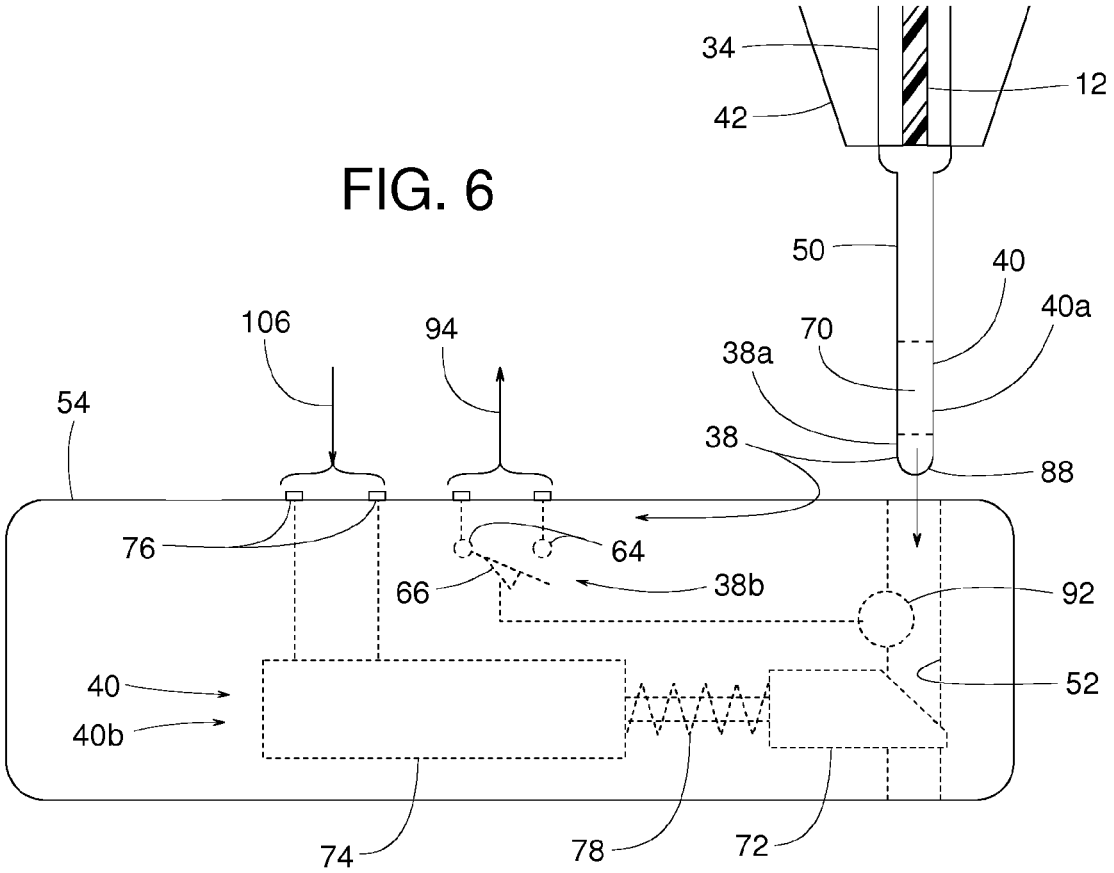
FIG. 6 is a schematic view showing an operational configuration of example second and third safety devices.
Figure 8:
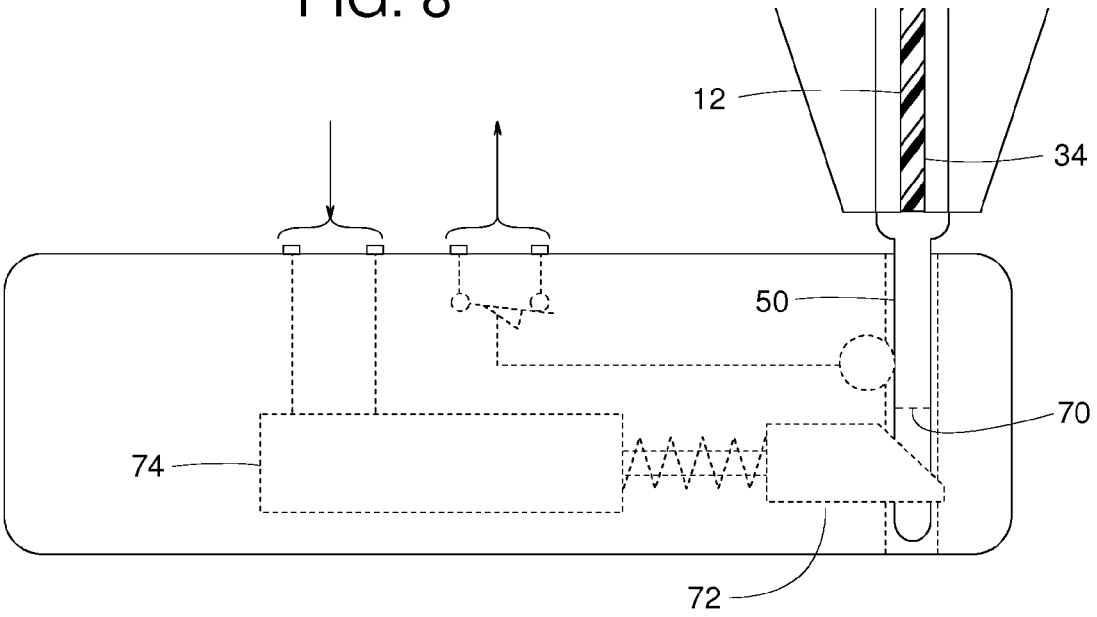
FIG. 8 is a schematic view similar to FIG. 6 but showing another operational configuration of the example second and third safety devices.
Figure 9:
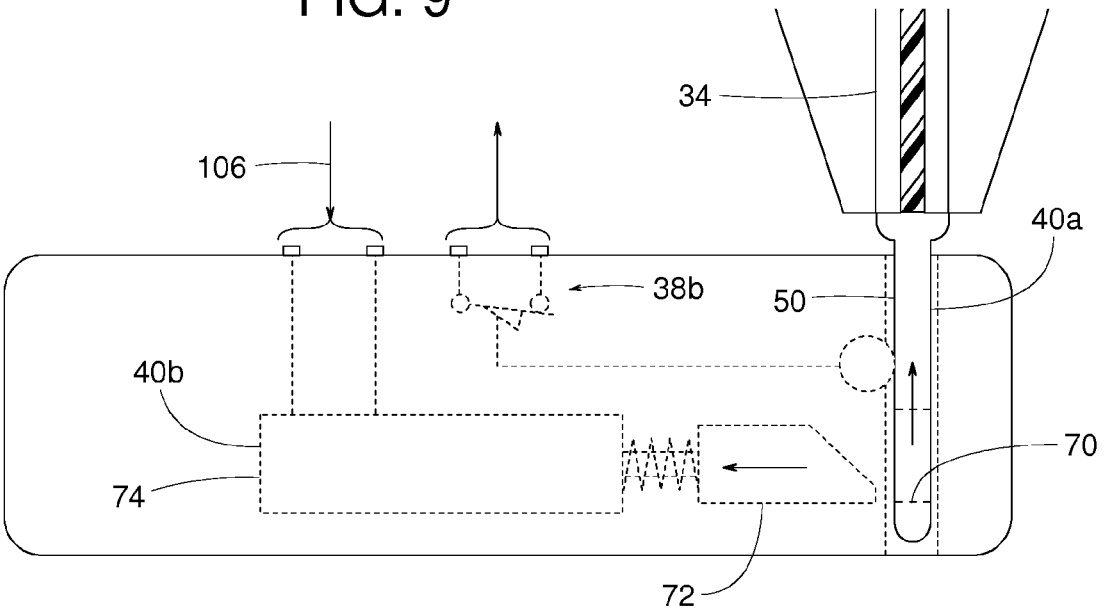
FIG. 9 is a schematic view similar to FIG. 6 but showing yet another operational configuration of the example second and third safety devices.

In some examples, third electrical portion 40*b* comprises solenoid 74, the solenoid's electrical terminals 76, plunger 72, and a spring 78 that urges plunger 72 from its retracted position (FIG. 9) to its normally extended position (FIGS. 6 and 8). Energizing solenoid 74 via terminals 76 drives solenoid 74 to retract plunger 72 from its normally extended position to its retracted position. De-energizing solenoid 74 allows spring 78 to extend plunger 72 if plunger 72 is not otherwise restricted to do so. Examples of third electrical portion 40*b* include, but are not limited to, the internal electrical solenoid of an Allen-Bradley model 440G-MT guard locking switch provided by Rockwell Automation of Milwaukee, Wis.; and the internal electrical solenoid of an Euchner model STA3A-4141A024RC18 safety switch provided by Euchner-USA, Inc. of East Syracuse, N.Y. In some examples, as mentioned earlier, second and third electrical portions 38*b* and 40*b* are contained within the commonly shared housing 54.

An example method of operating barrier 10 is as follows. Referring to FIGS. 2 and 6, an output signal 80 of controller 26 commands drive unit 20 to lower curtain 12 at a predetermined velocity to close barrier 10. In some examples, the predetermined velocity varies over the length of travel of curtain 12, e.g., curtain 12 accelerates and decelerates. Arrow 82 of FIG. 2 represents lowering curtain 12 at the predetermined velocity. In addition to drive unit 20 controllably releasing curtain 12, the curtain's weight, including the weight of guide plates 34, provides an appreciable downward force 84 for moving the curtain's leading edge 16 downward. FIG. 2 illustrates developing an appreciable magnitude of downward momentum 86 by virtue of curtain 12 traveling downward at the predetermined velocity. In some examples, particularly those where curtain 12 comprises a polymeric sheet of material and guide plate 34 comprises a metal material, guide plate 34 traveling with curtain 12 provides an appreciable percentage of the curtain's 12 downward momentum.

As leading edge 16 approaches its closed position of FIGS. 3, 5 and 8; beveled edge 46 engages lead-in surface 48 to physically guide and properly align wireless portions 36*a*, 38*a* and 40*a* to and/or with their respective electrical portions 36*b*, 38*b* and 40*b*. The term, "proper alignment" and derivatives thereof refer to horizontal and/or vertical positioning that achieves a desired result. The portions 36*a*, 36*b*, 38*a*, 38*b*, 40*a*, 40*b* may be properly aligned when the respective portions 36*a*, 36*b*, 38*a*, 38*b*, 40*a*, 40*b* are adjacent, engage and/or secured relative to one another. In addition or alternatively, a lower edge 88 of tongue 50 engages a secondary lead-in surface 90 (FIG. 4) on a spacer 91 to guide tongue 50 into slot 52 of housing 54. In other words, secondary lead-in surface 90 guides tongue 50 into the switch housing.

Figure 7:
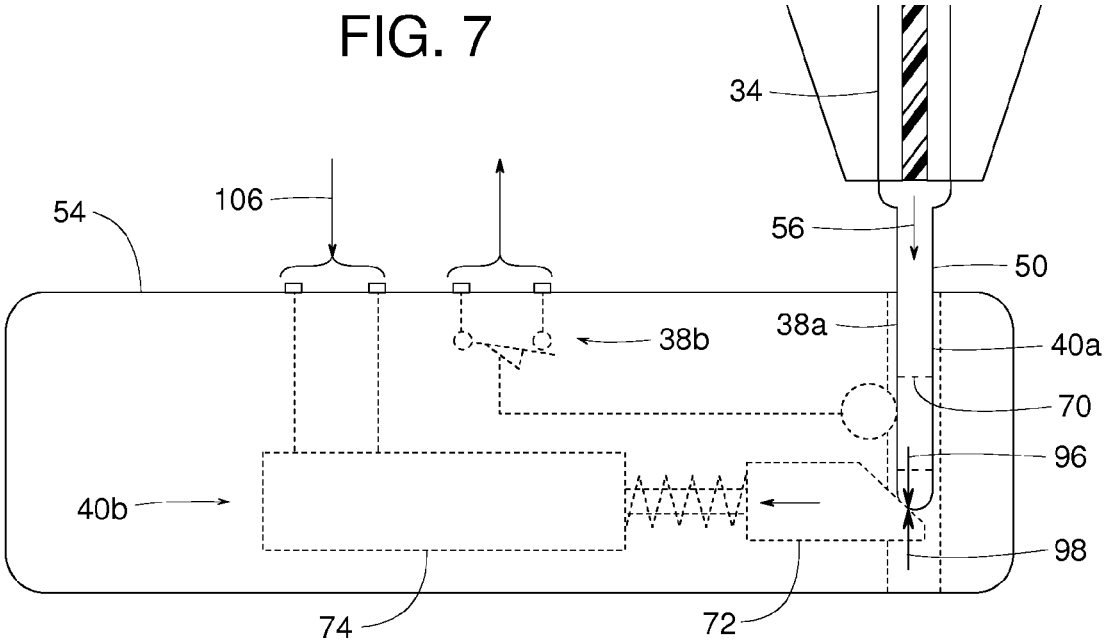
FIG. 7 is a schematic view similar to FIG. 6 but showing another operational configuration of the example second and third safety devices.

In some examples, as guide plate 34 lowers tongue 50 into slot 52, as shown in FIGS. 6 and 7, tongue 50 at some point engages a contact-moving member 92 (e.g., a button, lever, trigger, etc.) that closes/opens contacts 64 (e.g., from normally open to forced closed or from normally closed to forced open). Opening or closing contacts 64 provides controller 26 with a signal (e.g., feedback signal) 94 indicating whether barrier 10 is open or closed.

Also, in some examples, as tongue 50 enters slot 52, tongue 50 engages plunger 72, wherein plunger 72 is part of third electrical portion 40*b* of third safety device 40. FIG. 7 illustrates barrier 10 exerting a closing force 96 that pushes third wireless portion 40*a* (e.g., tongue 50) into latching engagement with the third electrical portion 40*b* (e.g., plunger 72) of third safety device 40, wherein closing force 96 in some examples comprises a combination result of the curtain's weight and the curtain's downward momentum 86. FIG. 7 also shows third electrical portion 40*b* of third safety device 40 exerting (e.g., via spring 78 and plunger 72) an upward resistive force 98 against third wireless portion 40*a* (e.g., against tongue 50) as closing force 96 pushes the third wireless portion 40*a* (e.g., tongue 50) into latching engagement with the third electrical portion 40*b* (e.g., plunger 72 of third electrical portion 40*b*), wherein closing force 96 is greater than upward resistive force 98.

In some examples, as shown in FIG. 2, drive unit 20 upon controllably releasing curtain 12 exerts a downward feed force 100 to curtain 12. FIG. 2 also illustrates transmitting a portion 102 of downward feed force 100 through curtain 12 and guide plate 34 to the third wireless portion 40*a* (e.g., to tongue 50), wherein portion 102 of downward feed force 100 reaching third wireless portion 40*a* is less than the upward resistive force 98 that third electrical portion 40*b* (e.g., plunger 72) exerts against third wireless portion 40*a*. So, although portion 102 helps in forcibly latching third safety device 40, in some examples, portion 102 alone is insufficient to latchingly engage tongue 50 within housing 54 of third safety device 40. Thus, the combination result of closing force 96, in this example, comprises the weight of curtain 12, the appreciable magnitude of downward momentum 86, and force portion 102 of downward feed force 100.

FIG. 2 also illustrates that while lowering curtain 12, barrier 10 avoids curtain 12 buckling and maintains curtain 12 generally taut in a vertical direction by limiting the curtain's 12 predetermined descending velocity and relying on the weight of curtain 12 and/or the weight of guide plate 34. In some examples, during some points along the curtain's 12 descent, drive unit 20 limits the curtain's 12 descending velocity to less than an object's terminal free-fall velocity or, in some examples, less than the curtain's 12 downward velocity achieved by gravity alone.

To control the operation of barrier 10, in some examples, first electrical portion 36*b* of first safety device 36 is communicatively coupled (e.g., via a wired or wireless connection) to convey a first and/or feedback signal 104 to controller 26, second electrical portion 38*b* of second safety device 38 is communicatively coupled (e.g., via a wired or wireless connection) to convey second signal 94 to controller 26, controller 26 is wired and/or communicatively coupled (e.g., via a wired or wireless connection) to third electrical portion 40*b* of third safety device 40 to convey an energizing and/or output signal 106 to solenoid 74, and controller 26 is communicatively coupled (e.g., via a wired or wireless connection) to drive unit 20 to convey output signal 80 that controls the operation of drive unit 20. Also, in some examples, controller 26 is communicatively coupled (e.g., via a wired or wireless connection) to receive a machine status signal 108 from a device 110 that indicates whether machinery 18 is in a predetermined safe state (e.g., inactive, not moving). As mentioned earlier, barrier 10 is particularly useful for guarding machinery (machine 18) having momentum that can maintain a level of danger for a period of time even after the machinery is turned off; consequently, machine status signal 108, in some examples, is used for determining whether third electrical portion 40*b* switch between its activated and deactivated states, thereby determining whether third safety device 40 releases curtain 12. In some examples, signals 80, 94, 104, 106 and 108 are used as follows:

Once first and second safety devices 36 and 38 determine that curtain 12 is closed and third safety device 40 latches and holds curtain 12 in the closed position, controller 26, in response to feedback signals 104 and 94 from respective first and second safety devices 36 and 38, enables and/or commands machine 18 to start operating (machine 18 being in an operating state). In some examples, the triggering or actuation of safety devices 36, 38 and 40 happen substantially simultaneously with perhaps only some inconsequential time delays. The triggering and/or actuation may occur substantially simultaneously to account for time delays caused by the curtain 12 moving to the fully closed position, for example. After machine 18 starts, in some examples, controller 26 prevents barrier 10 from opening until machine status signal 108 from device 110 indicates that machine 18 is safe or inactive (e.g., in a safe state). In some examples, the controller 26 prevents the the curtain 12 from opening by maintaining and/or enabling engagement between the third electrical portion 40*b* and the third wireless portion 40*a*. In some cases, due to machine momentum, machine 18 might not necessarily be safe or inactive immediately after machine 18 is de-energized or turned off (e.g., machine 18 being in a coast-down state with machine 18 moving due to momentum).

After status signal 108 indicates that it is safe to open barrier 10, controller 26, in some examples, outputs signal 106 that energizes solenoid 74. In some examples, energizing solenoid 74 releases third wireless portion 40*a* (e.g., tongue 50) by withdrawing plunger 72 from within opening 70. Controller 26 then outputs signal 80 to drive unit 20 to raise curtain 12.

Figure 10:
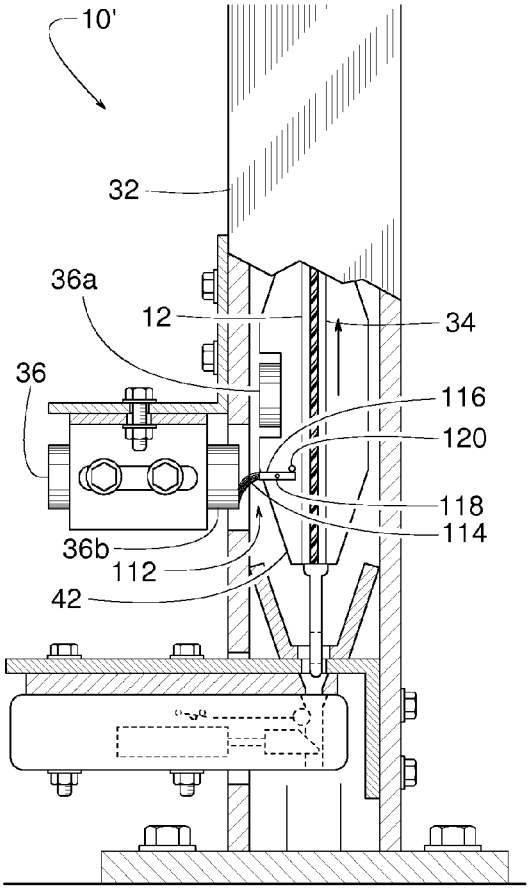
FIG. 10 is a cross-sectional cutaway view similar to FIG. 4 but showing an example cleaning device.
Figure 11:
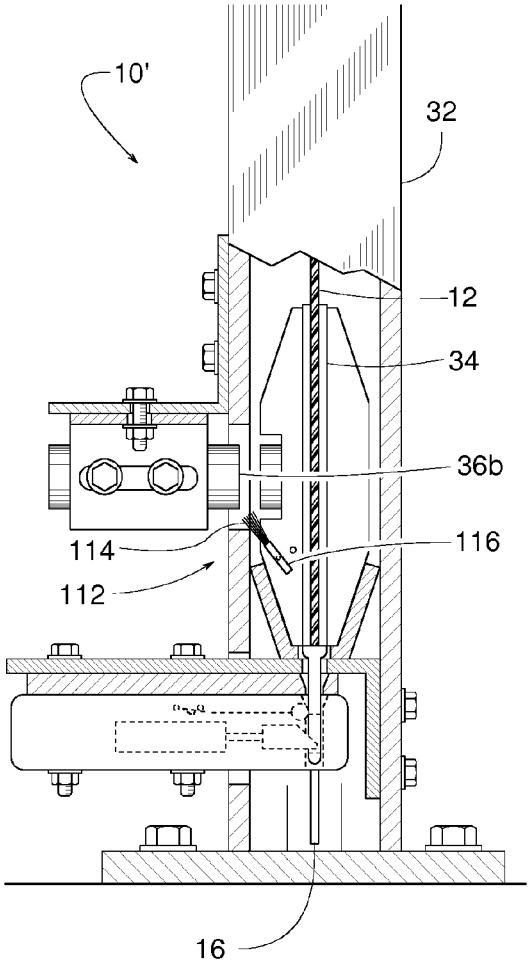
FIG. 11 is a cross-sectional cutaway view similar to FIG. 5 but showing the example cleaning device of FIG. 10.

In some examples, as shown in FIGS. 10 and 11, barrier 10' includes a cleaning device 112 for removing dust and other contaminants from one or more safety devices (e.g., first safety device 36). In some examples, cleaning device 112 provides less resistance to curtain 12 closing under its own weight than to curtain 12 opening under the power of drive unit 20. In some examples, cleaning device 112 comprises a brush 114 (e.g., bristles, wiper, etc.) extending from a pivoting lever 116. In some examples, a magnet replaces or is used in addition to brush 114 as a means for removing ferrous contaminants from one or more safety devices 36, 38 and/or 40. In the illustrated example of brush 114, a pin 118 pivotally connects lever 116 to guide member 42. A second pin 120 limits the rotational movement of lever 116 about pin 118. As drive unit 20 lifts curtain 12 up, as shown in FIG. 10, the curtain's 12 upward movement drags brush 114 upward across the face of first electrical portion 36*b* of first safety device 36. Brush 114 dragging upward across the face of first electrical portion 36*b* forces lever 116 to pivot counterclockwise, as viewed in FIG. 10, until second pin or stop 120 stops the lever's 116 rotation. This positions cleaning device 112 to where brush 114 can exert appreciable cleaning pressure against the face of first electrical portion 36*b*.

Later, when barrier 10' closes and curtain 12 descends, brush 114 dragging downward across the face of first electrical portion 36*b* tilts cleaning device 112 clockwise to the position shown in FIG. 11. In this tilted position, relatively little friction exists between brush 114 and the face of first electrical portion 36*b*, thus curtain 12 can readily descend without significant drag from brush 114.

In addition or alternatively, cleaning device 112 is used in a similar manner to clean the face of first wireless portion 36*a*. In such examples, cleaning device 112 is pivotally attached at some fixed location relative to track 32, and brush 114 drags across the face of first wireless portion 36*a* as barrier 10' opens and/or closes. As in the example illustrated in FIGS. 10 and 11, cleaning device 112 is still configured to provide greater frictional brushing force when curtain 12 rises then when curtain 12 descends.

Figure 12:
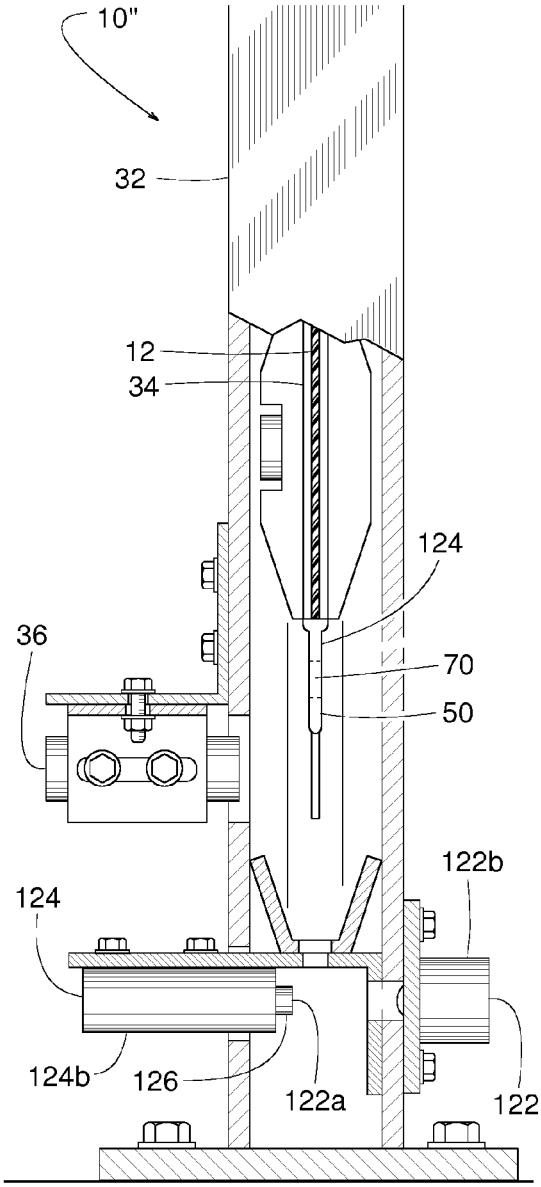
FIG. 12 is a cross-sectional cutaway view similar to FIG. 4 but showing another example safety device.
Figure 13:
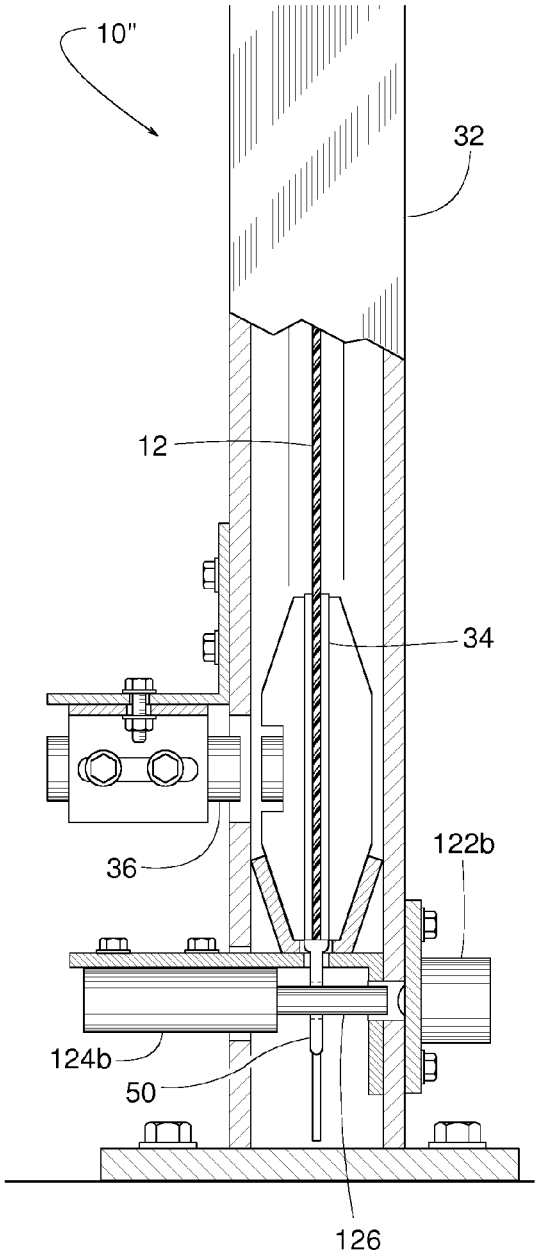
FIG. 13 is a cross-sectional cutaway view similar to FIG. 5 but showing the example safety device of FIG. 12.

In some example barriers 10", as shown in FIGS. 12 and 13, includes a second safety device 122 that comprises a second wireless portion 122*a* and a second electrical portion and/or proximity sensor 122*b*, and a third safety device 124 includes an opening or receptacle 70 in a tongue or extension 50 and a third electrical portion and/or solenoid 124*b*. In some examples, second electrical portion 122*b* is a proximity sensor (e.g., electric eye, Hall effect sensor, etc.), second wireless portion 122*a* is an axial face of a plunger 126 of a solenoid, and third electrical portion 124*b* is a solenoid.

Extending the solenoid's plunger 126 through opening 70, as shown in FIG. 13, latches and holds curtain 12 in its closed position. When third electrical portion 124*b* fully extends, second electrical portion 122*b* detects the presence of the second electrical portion (e.g., the axial face of the plunger) 122*a*, thereby determining that third safety device 124 is fully actuated. Controller 26 determines that barrier 10" is secure with curtain 12 latched in its closed position when second electrical portion 122*b* detects the second wireless portion 122*a* while first safety device 36 senses that curtain 12 is in its closed position.

Figure 14:
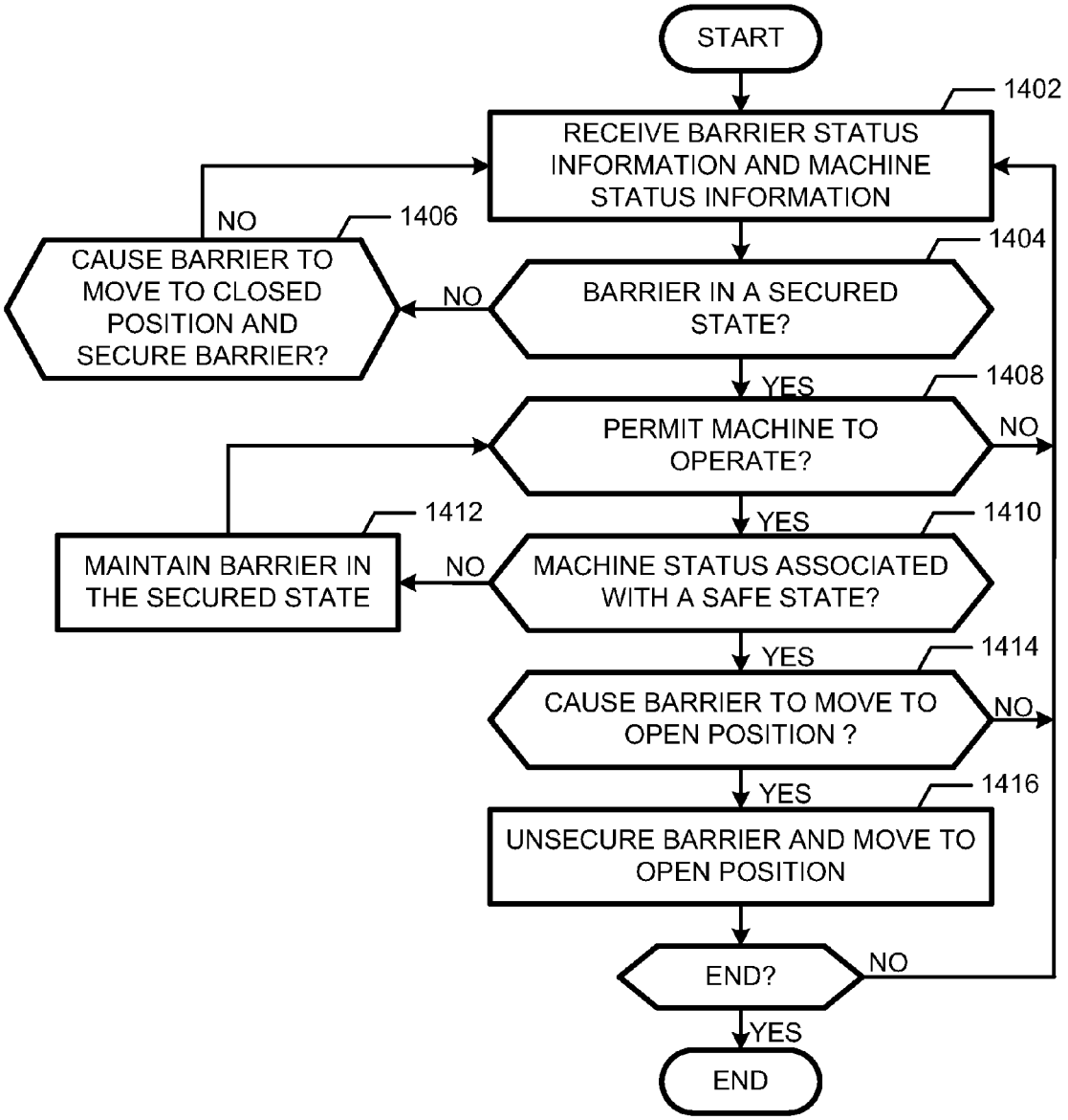
FIG. 14 is a diagram representative of machine readable instructions which may be executed to implement the apparatus of FIGS. 1-13, 16 and 17.

FIG. 14 is a flow diagram representative of example machine readable instructions which may be executed to implement the apparatus of FIGS. 1-13. The example computer readable instructions of FIG. 14 may be executed to control a barrier system based on feedback. The example processes of FIG. 14 may be performed using a processor, a controller and/or any other suitable processing device. For example, the example processes of FIG. 14 may be implemented using coded instructions (e.g., computer readable instructions) stored on a tangible computer readable medium such as a flash memory, a read-only memory (ROM), and/or a random-access memory (RAM). As used herein, the term tangible computer readable medium is expressly defined to include any type of computer readable storage and to exclude propagating signals. Additionally or alternatively, the example processes of FIG. 14 may be implemented using coded instructions (e.g., computer readable instructions) stored on a non-transitory computer readable medium such as a flash memory, a read-only memory (ROM), a random-access memory (RAM), a cache, or any other storage media in which information is stored for any duration (e.g., for extended time periods, permanently, brief instances, for temporarily buffering, and/or for caching of the information). As used herein, the term non-transitory computer readable medium is expressly defined to include any type of computer readable medium and to exclude propagating signals.

Alternatively, some or all of the example blocks of FIG. 14 may be implemented using any combination(s) of application specific integrated circuit(s) (ASIC(s)), programmable logic device(s) (PLD(s)), field programmable logic device(s) (FPLD(s)), discrete logic, hardware, firmware, etc. Also, some or all of the example blocks of FIG. 14 may be implemented manually or as any combination(s) of any of the foregoing techniques, for example, any combination of firmware, software, discrete logic and/or hardware. Further, although the example process of FIG. 14 is described with reference to the flow diagram of FIG. 14 other methods of implementing the process of FIG. 14 may be employed. For example, the order of execution of the blocks may be changed, and/or some of the blocks described may be changed, eliminated, sub-divided, or combined. Additionally, any or all of the example blocks of FIG. 14 may be performed sequentially and/or in parallel by, for example, separate processing threads, processors, devices, discrete logic, circuits, etc.

The example process of FIG. 14 begins when the controller 26 receives barrier information (e.g., feedback) from the first electrical portion 36*b*, the second electrical portion 38*b* and/or the third electrical portion 40*b* and/or when the controller 26 receives machine status information from the machine 18 (block 1402). In some examples, the barrier information includes information relating to the curtain 12 of the barrier 10 being in a closed position, a secure position, a non-secure position, an open position, etc. In some examples, the machine information includes information relating to the machine 18 being in a non-safe state, a safe state, operating state, etc.

The controller 26 determines if the barrier 10 is in a secured state (block 1404). The controller 26 may determine that the curtain 12 of the barrier 10 is in a secured state based on the feedback (e.g., barrier information) from the first electrical portion 36*b* and/or the second electrical portion 38*b*. If the barrier 10 is not in the secured state, the controller 26 determines whether or not to cause the barrier 10 to move to the closed position and to secure the barrier by, for example, requesting and receiving feedback from an operator using a user interface (e.g., monitor, keyboard, etc.) (block 1406) and/or based on the feedback received at block 1402.

If the barrier 10 is in the secured state, the controller 26 determines whether or not to permit the machine 18 to operate by, for example, requesting and receiving feedback from an operator (e.g., monitor, keyboard, etc.) and/or based on the feedback received at block 1402 (block 1408). If the controller 26 determines to permit the machine to operate, the controller 26 determines if the machine status is associated with a safe state based on, for example, feedback received at block 1402 (block 1410). The machine 18 may be associated with a safe state if, for example, parts of the machine 18 that may cause injury to an operator are not moving (e.g., a saw blade) and/or are in a safe position. If the controller 26 determines that the machine 18 is not in a safe state, the controller 26 maintains the barrier 10 in the secured position until a safe state is achieved (block 1412).

If the controller 26 determines that the machine 18 is in a safe state, the controller 26 determines whether or not to cause the barrier 10 to move to the open position by, for example, requesting and receiving feedback from an operator using a user interface (e.g., monitor, keyboard, etc.) and/or based on feedback received at block 1402 (block 1414). If the barrier 10 is to be moved to the open position, the controller 26 causes the curtain 12 to be moved to the open position (block 1416).

Figure 15:
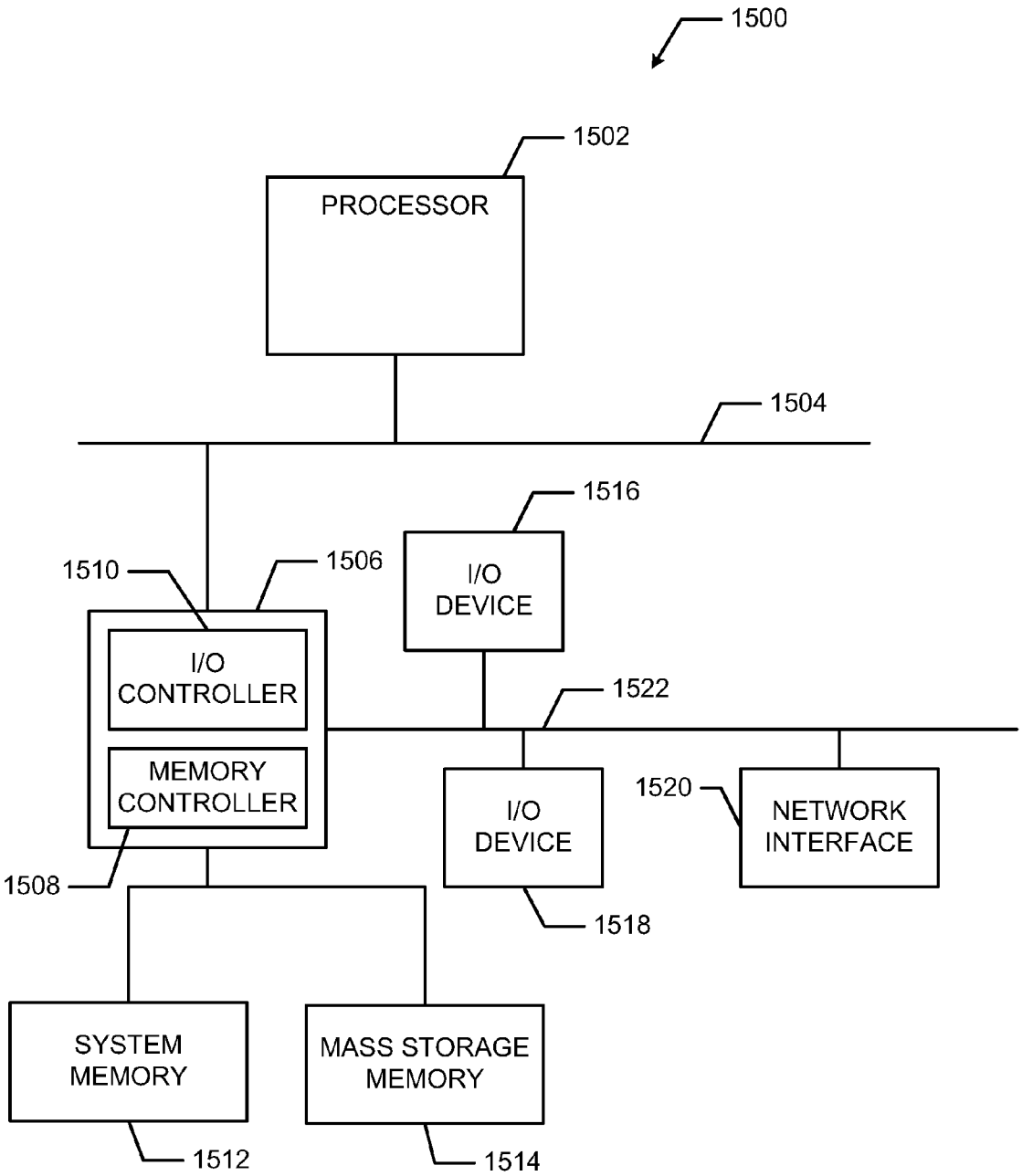
FIG. 15 is a block diagram of an example processor system that can execute the instructions of FIG. 14 to implement the apparatus of FIGS. 1-13, 16 and 17.

FIG. 15 is a block diagram of an example processor system 1500 that may be used to execute the example instructions of FIG. 14 to control a barrier. As shown in FIG. 15, the processor system 1500 includes a processor 1502 that is coupled to an interconnection bus 1504. The processor 1502 may be any suitable processor, processing unit or microprocessor and may implement the controller 26. The processor system 1500 may be a multi-processor system and, thus, may include one or more additional processors that are identical or similar to the processor 1502 and that are communicatively coupled to the interconnection bus 1504.

The processor 1502 of FIG. 15 is coupled to a chipset 1506, which includes a memory controller 1508 and an input/output (I/O) controller 1510. The chipset 1506 typically provides I/O and memory management functions as well as a plurality of general purpose and/or special purpose registers, timers, etc. that are accessible or used by one or more processors coupled to the chipset 1506. The memory controller 1508 performs functions that enable the processor 1502 (or processors if there are multiple processors) to access a system memory 1512 and a mass storage memory 1514.

The system memory 1512 may include any desired type(s) of volatile and/or non-volatile memory such as, for example, static random access memory (SRAM), dynamic random access memory (DRAM), flash memory, read-only memory (ROM), etc. The mass storage memory 1514 may include any desired type(s) of mass storage device including hard disk drives, optical drives, tape storage devices, etc.

The I/O controller 1510 performs functions that enable the processor 1502 to communicate with peripheral input/output (I/O) devices 1516 and 1518 and a network interface 1520 via an I/O bus 1522. The I/O devices 1516 and 1518 may be any desired type of I/O device such as, for example, a keyboard, a video display or monitor, a mouse, etc. The network interface 1520 may be, for example, an Ethernet device, an asynchronous transfer mode (ATM) device, an 802.11 device, a DSL modem, a cable modem, a cellular modem, etc. that enables the processor system 1500 to communicate with other devices such as the sensors described above.

While the memory controller 1508 and the I/O controller 1510 are depicted in FIG. 15 as separate blocks within the chipset 1506, the functions performed by these blocks may be integrated within a single semiconductor circuit or may be implemented using two or more separate integrated circuits.

Figure 16:
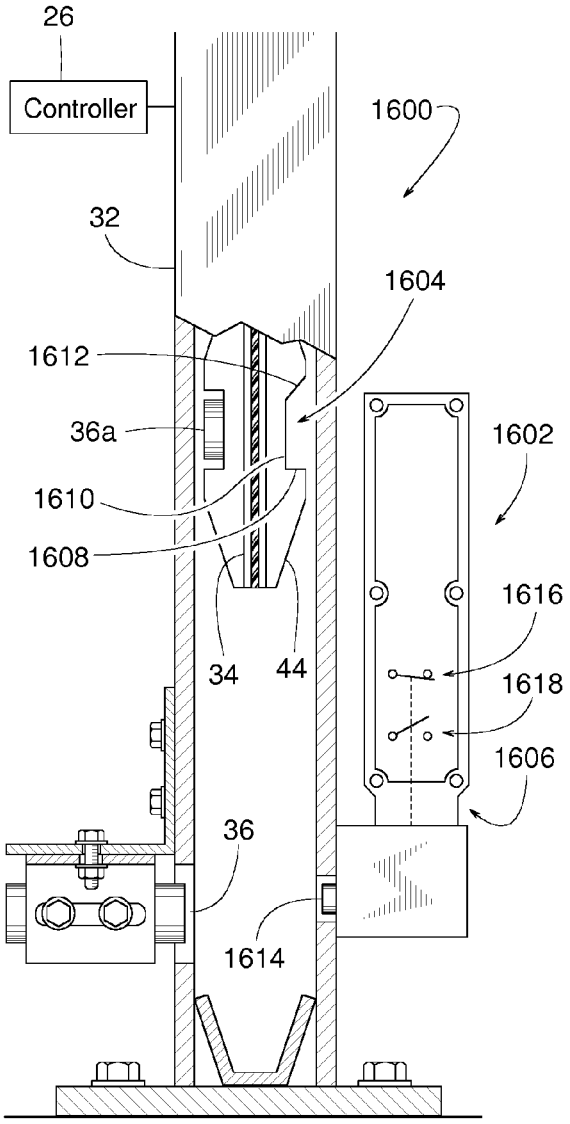
FIGS. 16 and 17 are cross-sectional views of an example safety barrier that can be used to implement the examples disclosed herein.
Figure 17:
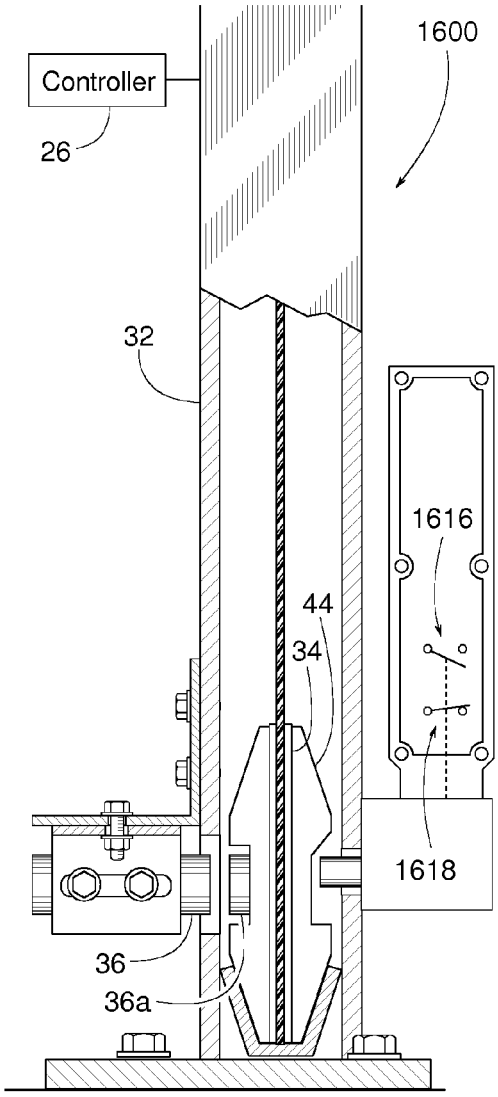

FIGS. 16 and 17 depict an example barrier 1600 that can be used to implement the examples disclosed herein. The example barrier 1600 may include fewer parts, may be easier to assemble and/or provide a secure connection to retain the barrier 1600 in the closed position. The example barrier 1600 includes a second safety device 1602 that includes a groove, portion, receptacle and/or cutout 1604 and a locking mechanism and/or solenoid 1606. The groove 1604 may include a first surface or step 1608, a second surface 1610 and a third or tapered surface 1612.

To enable an extension, portion or plunger 1614 to securely engage the groove 1604 and, thus, secure the barrier 1600 in the closed position, the first surface 1608 may be substantially perpendicular to the second surface 1610. To enable the plunger 1614 to easily enter the groove 1604, the third surface 1612 may be tapered. In this example, the first wireless portion 36*a* and the cutout 1604 are oppositely positioned on and/or in the guide plate 34. However, the first and second safety devices 36 and 1602 may be positioned differently. For example, the second safety device 1602 may be positioned such that when the plunger 1614 extends, the plunger 1614 engages a top surface of the guide plate 34 and/or the guide member 44. In such examples, the top surface of the guide plate 34 and/or the guide member 44 may be substantially non-tapered. Additionally or alternatively, the second safety device 1602 may be positioned ninety degrees relative to the first safety device 36 about a longitudinal axis of the track 32.

In some examples, the second electrical portion 1606 is a Safety Switch with Guard Locking Pin from Euchner. However, any other device may be used to secure the barrier 1600 in the closed position. Further, while not shown, the example barrier 1600 may include additional and/or alternative safety devices as disclosed herein.

In operation, the controller 26 may receive information from the first safety device (e.g., a proximity sensor, a sensor) 36 that the barrier 1600 is in the closed position. When the controller 26 determines that the barrier 1600 is in the closed position, the controller 26 may cause the plunger 1614 to extend into the groove 1604 to secure the barrier 1600 in the closed position. The controller 26 may determine that the barrier 26 is in the closed position based on feedback received from the first safety device 36 and/or associated safety relay. In the extended position, a first connection 1616 of the second electrical portion 1606 may not be made and a second connection 1618 of the second electrical portion 1606 may be made. Information relating to the first and/or second connections 1616 and/or 1618 may be conveyed to the controller 26. Such information may be used by the controller 26 to determine if the barrier 1600 is secured in the closed position. If the controller 26 receives information that the equipment is in a safe state, the controller 26 may cause the plunger 1614 to retract from the groove 1604 to enable the barrier 1600 to be moved to the open position. In the retracted position, the first connection 1616 may be made and the second connection 1618 may not be made. Information relating to the first and/or second connections 1616 and/or 1618 may be conveyed to the controller 26. Such information may be used by the controller 26 to determine if the barrier 1600 is in an unsecured position.

Although certain example methods, apparatus and articles of manufacture have been disclosed herein, the scope of the coverage of this patent is not limited thereto. On the contrary, this patent covers all methods, apparatus and articles of manufacture fairly falling within the scope of the claims of this patent either literally or under the doctrine of equivalents.

What is claimed is:

1. A safety barrier assembly to control access to equipment, comprising:

a track;

a harrier to be moveable within the track between an open position and a closed position, the open position enabling access to the equipment, the closed position substantially preventing access to the equipment;

guide members to be mounted to the barrier, the guide members to be retained entirely within the track to guide the movement of the barrier, the guide members including a receptacle;

a sensor to trigger a signal that identifies when the barrier is in the closed position;

a lock including a portion to the extended into the receptacle in response to the signal, an interaction between the portion and the receptacle to prevent the barrier from moving out of the closed position; and a controller responsive to feedback indicating the equipment is in a safe state to cause the barrier to move from the closed position to the open position.

2. The safety barrier assembly of claim 1, wherein the guide members include a tapered surface to engage a lead-in-surface of the safety barrier assembly to enable alignment of the barrier relative to at least one of the sensor or the lock.

3. The safety barrier assembly of claim 1, wherein the controller is to cause the portion to extend into the receptacle in response to the signal from the from the sensor.

4. The safety barrier assembly of claim 1, wherein the receptacle comprises an aperture.

5. The safety barrier assembly of claim 1, wherein the barrier comprises a flexible curtain.

6. The safety barrier of claim 1, wherein the portion comprises a plunger.

7. The safety barrier of claim 1. wherein the receptacle is to be in a fixed position relative to the barrier.

8. The safety barrier assembly of claim 1. wherein a first one of the guide members is mounted to a first side of the barrier and a second one of the guide members is mounted to a second side of the barrier opposite the first side.

9. The safety barrier assembly of claim 1, wherein the receptacle is a groove having a first surface substantially perpendicular to an outer surface of the guide members and a second surface that is tapered, wherein the first surface is closer to a bottom of the barrier than the second surface.

10. A safety barrier assembly to control access to equipment, comprising:

a track defining slot;

a barrier extending through the slot into the track, the barrier moveable within the track between an open position and a closed position, the open position to enabling access to the equipment, the closed position to substantially preventing access to the equipment;

a guide member to be attached to the barrier and retained entirely within the track, the guide member having a thickness greater than a width of the slot to retain the guide member within the track;

a sensor to identify when the barrier is in the closed position by detecting a target on the guide member, the target retained entirely within the track;

a lock lo engage a receptacle of the guide member in response to the signal, an interaction between the lock and the receptacle to prevent the barrier from moving out of the closed position; and a controller to provide a first electrical input to cause the lock to engage the portion receptacle of the guide member in response to the signal, the controller to provide a second electrical input responsive to feedback indicating the equipment is in a safe state, the second electrical input to cause the lock to disengage the receptacle of the guide member to enable the barrier to move to the open position.

11. The safety barrier assembly of claim 10, wherein the receptacle includes a tapered surface to enable the lock to be guided into the receptacle.

12. The safety barrier assembly of claim 10, wherein the equipment is in the safe state when the equipment is at least one of inactive or not moving.

13. The safely barrier assembly of claim 10, wherein the equipment has momentum when not in the safe stale.

14. The safety barrier assembly of claim 10, further including a tapered lead-in surface having a shape substantially conforming to a shape of the guide member, the tapered lead-in surface to matingly engage with the guide member when the barrier is in the closed position to hold the guide member in alignment relative to at least one of the sensor or the lock.

15. A method of providing a safety barrier assembly to control access to equipment, comprising:

providing a track;

providing a barrier that includes a guide member to be retained entirely within the track, the barrier to be moveable within the track between an open position and a closed position, the open position to enabling access to the equipment, the closed position substantially preventing access to the equipment;

coupling a sensor to the track, the sensor to trigger a signal that identifies when the barrier is in the closed position; and coupling an electrically activatable plunger to the track, the electrically activatable plunger to extend into the guide member in response to the signal and to retract from the guide member based on feedback indicating that the equipment is in a state safe to be accessed, the barrier to automatically move the open position in response to the feedback.

16. The method of claim 15, further including coupling a target to the guide member, the target to enable the sensor to identify when the barrier is in the closed position.

* * * * *

UNITED STATES PATENT AND TRADEMARK OFFICE

CERTIFICATE OF CORRECTION

PATENT NO. : 9,309,717 B2
APPLICATION NO. : 13/402662
DATED : April 12, 2016
INVENTOR(S) : Hardison et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 414 days.

In the Claims:

Column 12, line 29 (Claim 1): Replace "harrier" with --barrier--.
Column 12, line 39 (Claim 1): Replace "a portion to the" with --a portion to be--.
Column 12, line 50 (Claim 3): Replace "from the from the sensor" with --from the sensor--.
Column 12, line 54 (Claim 4): Replace "comprises" with --includes--.
Column 12, line 56 (Claim 5): Replace "comprises" with --includes--.
Column 12, lines 57-58 (Claim 6): Replace "comprises" with --includes--.
Column 12, line 59 (Claim 7): Replace "1." with --1,--.
Column 12, line 61 (Claim 8): Replace "1." with --1,--.
Column 13, line 5 (Claim 10): After "a track defining", insert --a--.
Column 13, line 8 (Claim 10): After "the open position", delete "to".
Column 13, line 9 (Claim 10): After "the closed position", delete "to".
Column 13, line 15 (Claim 10): Replace "identify when" with --trigger a signal indicating--.
Column 13, line 18 (Claim 10): After "a lock", replace "lo" with --to--.
Column 13, line 23 (Claim 10): After "to engage the", delete "portion".
Column 14, line 1 (Claim 13): Replace "safely" with --safety--.
Column 14, line 2 (Claim 13): Replace "stale." with --state.--.
Column 14, line 16 (Claim 15): After "the open position", delete "to".

Signed and Sealed this
Twenty-first Day of June, 2016

Michelle K. Lee

Michelle K. Lee
*Director of the United States Patent and Trademark Office*